US009028189B2

(12) United States Patent
Sasaki et al.

(10) Patent No.: US 9,028,189 B2
(45) Date of Patent: May 12, 2015

(54) BOOKLET STACKER, RING-BINDING DEVICE, RING-BINDING SYSTEM, AND BOOKLET STACKING METHOD

(75) Inventors: Takeshi Sasaki, Tokyo (JP); Junichi Iida, Kawasaki (JP); Shingo Matsushita, Tokyo (JP); Satoshi Saito, Kawasaki (JP); Ikuhisa Okamoto, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 1123 days.

(21) Appl. No.: 12/801,768

(22) Filed: Jun. 24, 2010

(65) Prior Publication Data

US 2010/0329821 A1 Dec. 30, 2010

(30) Foreign Application Priority Data

Jun. 30, 2009 (JP) ..... 2009-155647
Feb. 19, 2010 (JP) ..... 2010-035193

(51) Int. Cl.

| | |
|---|---|
| ***B42D 1/00*** | (2006.01) |
| ***B42C 9/00*** | (2006.01) |
| ***B42C 5/00*** | (2006.01) |
| ***B42B 5/00*** | (2006.01) |
| ***B42B 5/06*** | (2006.01) |
| ***B42B 5/08*** | (2006.01) |
| ***B42B 5/10*** | (2006.01) |
| ***B42B 9/00*** | (2006.01) |
| ***B65H 29/18*** | (2006.01) |
| ***B65H 31/10*** | (2006.01) |

(Continued)

(52) U.S. Cl.

CPC ..... *B42B 5/103* (2013.01); *B65H 29/18* (2013.01); *B65H 31/10* (2013.01); *B65H 31/34* (2013.01); *B65H 2301/163* (2013.01); *B65H 2301/331* (2013.01); *B65H 2301/42112* (2013.01); *B65H 2301/4213* (2013.01); *B65H 2402/351* (2013.01); *B65H 2403/51* (2013.01); *B65H 2404/725* (2013.01); *B65H 2701/1932* (2013.01); *B65H 2801/27* (2013.01); *G03G 15/6544* (2013.01); *G03G 2215/00822* (2013.01)

(58) Field of Classification Search

USPC ..... 281/15.1, 21.1; 412/9, 20, 25, 33, 34, 412/38, 39, 40, 42

See application file for complete search history.

(56) References Cited

U.S. PATENT DOCUMENTS 4,569,620 A * 2/1986 Lynch ..... 412/21
5,213,193 A * 5/1993 Mullins ..... 198/416

(Continued)

FOREIGN PATENT DOCUMENTS

JP 2008037610 A 2/2008
JP 2008063105 A 3/2008

(Continued)

*Primary Examiner* — Shelley Self
*Assistant Examiner* — Justin V Lewis
(74) *Attorney, Agent, or Firm* — Harness, Dickey & Pierce, P.L.C.

(57) ABSTRACT

A booklet stacker to stack multiple booklets each bound with a ring member includes a stack tray on which multiple booklets are stacked, a shifter disposed upstream from the stack tray in a booklet conveyance direction in which a booklet is conveyed, the shifter to adjust a position of the booklet in a width direction perpendicular to the booklet conveyance direction by shifting the booklet a distance shorter than a ring pitch of the ring member in the width direction, and a booklet conveyer disposed upstream from the stack tray in the booklet conveyance direction, to convey the booklet positioned by the shifter to the stack tray.

10 Claims, 9 Drawing Sheets

(51) Int. Cl.
*B65H 31/34* (2006.01)
*G03G 15/00* (2006.01)

(56) References Cited

U.S. PATENT DOCUMENTS

| | | | | |
|---|---|---|---|---|
| 5,450,940 | A * | 9/1995 | Rathert et al. | 198/412 |
| 6,142,721 | A * | 11/2000 | Marsh | 412/1 |
| 7,328,892 | B2 | 2/2008 | Asami et al. | |
| 7,631,860 | B2 | 12/2009 | Asami et al. | |
| 2004/0126163 | A1 | 7/2004 | Asami et al. | |
| 2007/0166130 | A1 * | 7/2007 | Kurabayashi et al. | 412/38 |
| 2007/0182082 | A1 | 8/2007 | Asami et al. | |
| 2008/0075560 | A1 * | 3/2008 | Kurabayashi et al. | 412/38 |
| 2009/0152787 | A1 | 6/2009 | Sasaki | |
| 2009/0232622 | A1 | 9/2009 | Okada et al. | |
| 2009/0252545 | A1 | 10/2009 | Sasaki | |
| 2009/0257846 | A1 | 10/2009 | Matsushita et al. | |
| 2009/0263212 | A1 | 10/2009 | Sasaki et al. | |
| 2009/0269167 | A1 | 10/2009 | Iida et al. | |
| 2010/0239391 | A1 | 9/2010 | Sasaki et al. | |

FOREIGN PATENT DOCUMENTS

| | | | |
|---|---|---|---|
| JP | 2008094081 | A | 4/2008 |
| JP | 2008280170 | A | 11/2008 |

* cited by examiner

BOOKLET STACKER, RING-BINDING DEVICE, RING-BINDING SYSTEM, AND BOOKLET STACKING METHOD

CROSS-REFERENCE TO RELATED APPLICATIONS

This patent specification is based on and claims priority from Japanese Patent Application Nos. 2009-155647, filed on Jun. 30, 2009, and 2010-035193, filed on Feb. 19, 2010 in the Japan Patent Office, each of which is hereby incorporated by reference herein in its entirety.

BACKGROUND OF THE INVENTION

1. Field of the Invention

The present invention generally relates to a booklet stacker to stack multiple booklets, a ring-binding device including the booklet stacker, a ring-binding system including an image forming apparatus and the ring-binding device, and a booklet stacking method.

2. Discussion of the Background Art

At present, finishers to perform post-processing, such as aligning, sorting, stapling, punching, and/or bookbinding, of multiple sheets of recording media discharged from image forming apparatuses, such as copiers, printers, facsimile machines, or multifunction devices including at least two of these functions, are widely used.

In the field of bookbinding, ring binding is widely used. Ring binding involves punching an end portion of a bundle of sheets and then binding the bundle of sheets together using a binder including metal or plastic rings or coils. At present, a need has arisen for various types of bookbinding of sheets of recording media discharged from image forming apparatuses. Accordingly, there is a need for finishers or post-processing apparatuses to perform various types of post-processing.

In response to such a need, ring-binding devices that can perform ring binding online (i.e., automatically) have come to be used in addition to conventional bookbinding devices that perform end-stitching, that is, stapling one edge portion of sheets. There are ring-binding devices that include a booklet stacker to stack multiple bundles of sheets each of which is bound with a ring member (hereinafter "ring-bound booklets"). In such ring-binding devices, a greater number of booklets can be stacked, which obviates the need to remove the finished booklets from the ring-binding device frequently, thus increasing efficiency in ring binding.

However, conventional booklet stackers like that shown in FIG. 11 suffer from a flaw. The is, conventional booklet stackers typically simply pile ring-bound booklets 100 one on another on a booklet stacker 34X as shown in FIG. 11, and as a result ring members 28X binding the respective booklets 100 overlap or interfere with each other. Consequently, it is difficult to increase the number of booklets stacked on the booklet stacker 34X because the pile of multiple booklets tilts. Additionally, when multiple booklets 100 are stacked on the booklet stacker 34X, any given ring member 28X can damage adjacent booklets 100 piled on and under that ring member 28X. As the pile of multiple booklets 100 tilts, the booklets 100 should be aligned again after the booklets 100 are removed from the booklet stacker 34X. If not aligned again, handling of the booklets 100 becomes difficult because the tilted pile of booklets 100 cannot be packed neatly or transported safely.

In view of the foregoing, for example, in JP-2008-280170-A, a ring-binding device including a mechanism to move the stack tray vertically (e.g., an elevation mechanism) has been proposed. More specifically, this ring-binding device includes a discharge member to discharge booklets through a discharge port to the stack tray, the elevation mechanism to move the stack tray vertically, an upper-end sensor to detect an upper end of the booklets stacked on the stack tray, and a controller to control the elevation mechanism according to results of detection by the upper-end detector. The controller controls the elevation mechanism so that the upper end of the booklets stacked on the stack tray is aligned with a reference position disposed at a predetermined vertical distance from the discharge port. Thus, the stack tray is moved to a position at a given vertical distance from the discharge port so that the booklet can be discharged through the discharge port onto the stack tray smoothly.

However, although generally successful at conveying the booklet smoothly from the discharge port to the stack tray, this approach does not address the problem of overlap or interference of the ring members 28X binding the respective booklets described above. Consequently, the pile of booklets cannot be kept flat, and thus the number of booklets that can be stacked on the stack tray is limited. Further, this approach does not address the damage to the booklets caused by the ring members or the need to realign the booklets after removal from the stack tray.

In view of the foregoing, the inventors of the present invention recognize that there is a need to keep the piled ring-bound booklets flat on the stack tray, to prevent damage to the booklets, and to facilitate good alignment of the booklets after removal from the stack tray.

SUMMARY OF THE INVENTION

In view of the foregoing, one illustrative embodiment of the present invention provides a booklet stacker to stack multiple booklets each bound with a ring member, discharged from a sheet processing device. The booklet stacker includes a stack tray on which multiple booklets are stacked, a shifter disposed upstream from the stack tray in a booklet conveyance direction in which a booklet is conveyed, and a booklet conveyer disposed upstream from the stack tray in the booklet conveyance direction. The shifter adjusts a position of the booklet in a width direction perpendicular to the booklet conveyance direction by shifting the booklet a distance shorter than a ring pitch of the ring member in the width direction, and then the booklet conveyer conveys the booklet positioned by the shifter to the stack tray.

In another illustrative embodiment, a ring-binding device includes a punch unit to form multiple ring holes on a bundle of sheets, a ring-binding unit to bind the bundle of sheets into a booklet by inserting rings of a ring member into the ring holes formed in the bundle of sheet, and the booklet stacker described above.

Yet in another illustrative embodiment, the ring-binding device described above is incorporated in a ring-binding system comprising an image forming apparatus connected to an upstream side of the ring-binding device in the booklet conveyance direction.

Yet another illustrative embodiment provides a method of staking on a stack tray multiple booklets each bound with a ring member, discharged from a sheet processing device.

The method includes a step of adjusting a position of the booklet in a width direction perpendicular to a booklet conveyance direction in which the booklet is conveyed by moving the booklet a distance shorter than a pitch of the ring member in the width direction at a position upstream from the stack tray, a step of conveying the booklet to the stack tray, and a step of stacking booklets on the stack tray.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
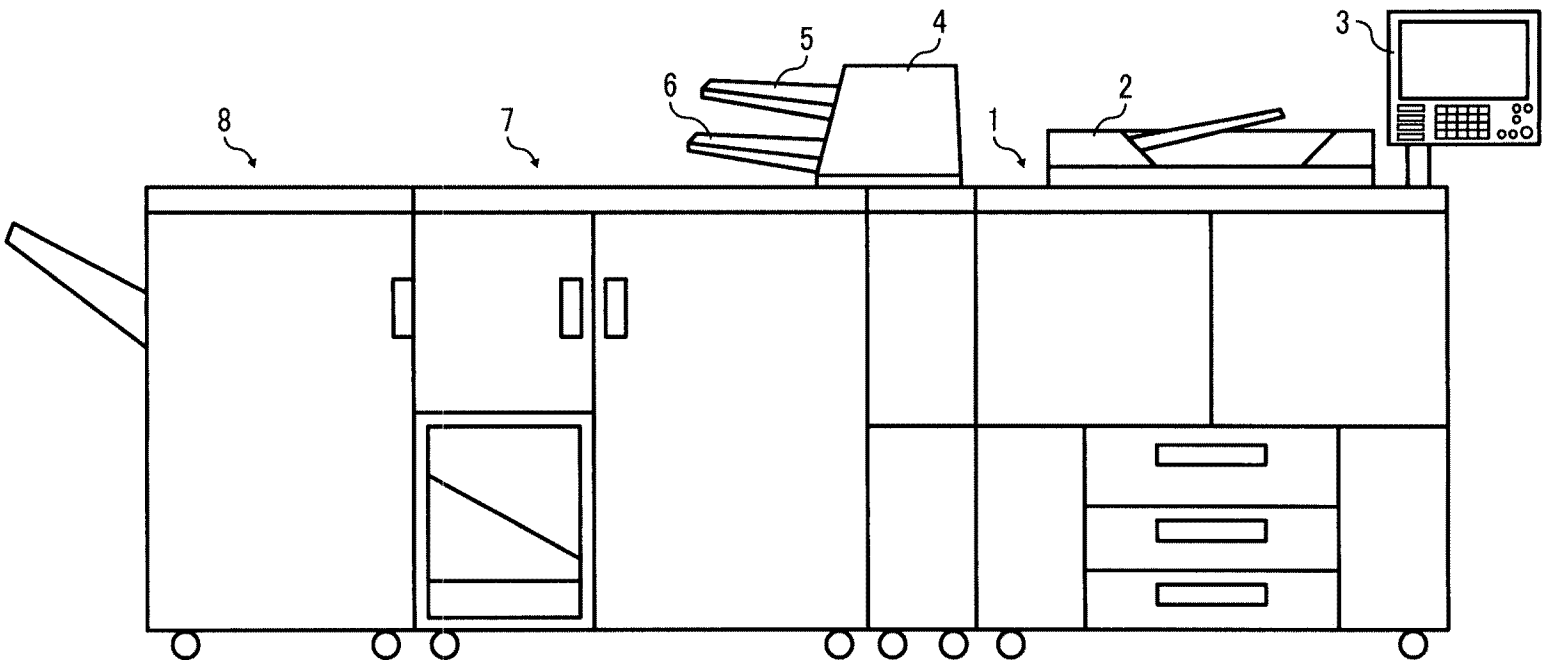
FIG. 1 is a front view illustrating a configuration of a bookbinding system according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a ring-binding system according to an illustrative embodiment of the present invention is described.

FIG. 1 is a front view illustrating exterior of the bookbinding system according to an illustrative embodiment of the present invention.

Referring to FIG. 1, the bookbinding system according to the present embodiment includes an image forming apparatus 1, an inserter 4, a ring-binding device 7, and a finisher 8 connected in series.

In the present embodiment, the image forming apparatus 1 is a digital multifunction machine capable of at least two of copying, printing, and facsimile transmission (hereinafter also "MFP 1"). The MFP 1 includes an automatic document feeder (ADF) 2 and a control unit (operation panel) 3 provided with a display. The inserter 4 is connected to a downstream side of the MFP 1 in a direction in which sheets of recording media are transported in the bookbinding system shown in FIG. 1 (hereinafter "sheet conveyance direction"). The inserter 4 includes two sheet trays 5 and 6 to accommodate sheets on which images have been formed or sheets that the MFP 1 cannot accommodate and feeds such sheets to the ring-binding device 7 or the finisher 8. Such sheets can be inserted in a bundle of sheets to be bound together by the ring-binding device 7 or the finisher 8. The ring-binding device 7 is connected to a downstream side of the inserter 4, and the finisher 8 is disposed extreme downstream in the bookbinding system in the sheet conveyance direction. In the bookbinding system shown in FIG. 1, the ring-binding device 7 punches, aligns, and then binds together a bundle of sheets into a booklet with a ring binder. The finisher 8 can perform post-processing of sheets, such as aligning, sorting, stapling, and punching one through four punch holes, for example, through a known method although descriptions thereof are omitted.

Figure 10:
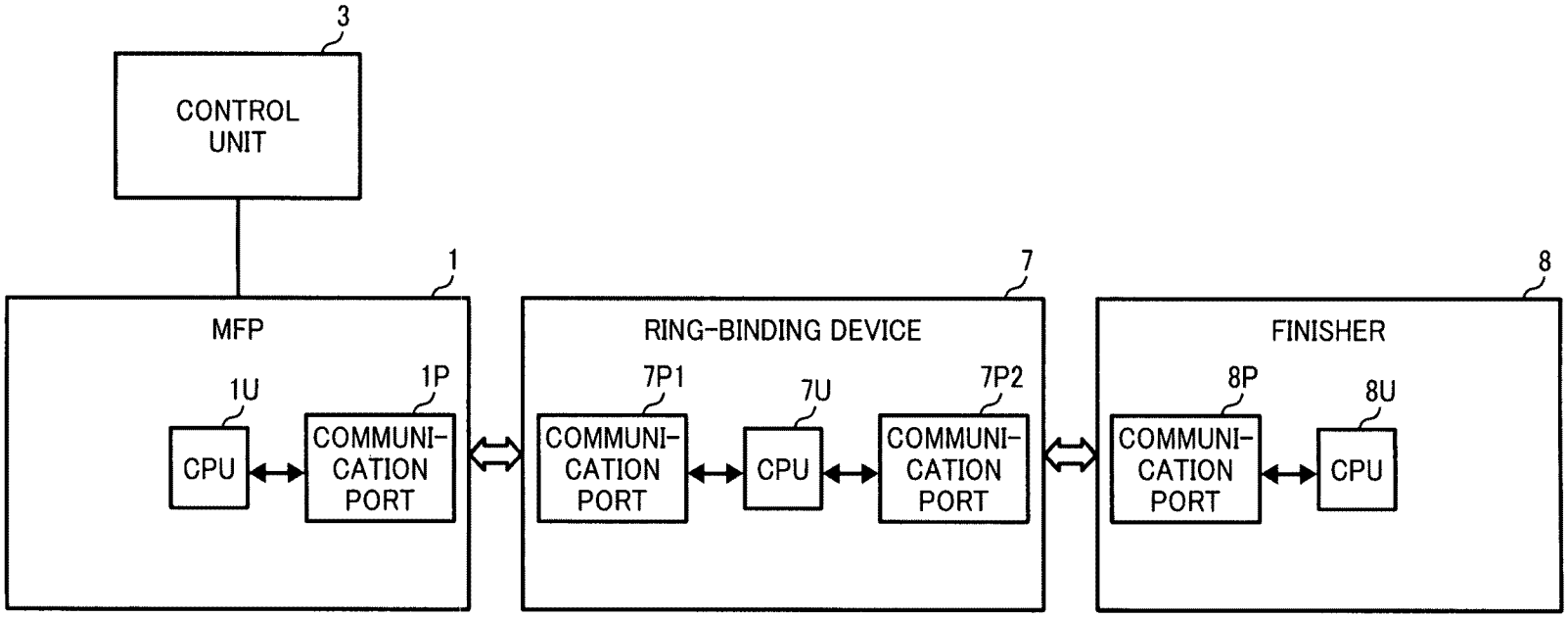
FIG. 10 is a control block diagram of the bookbinding system shown in FIG. 1.
Figure 11:
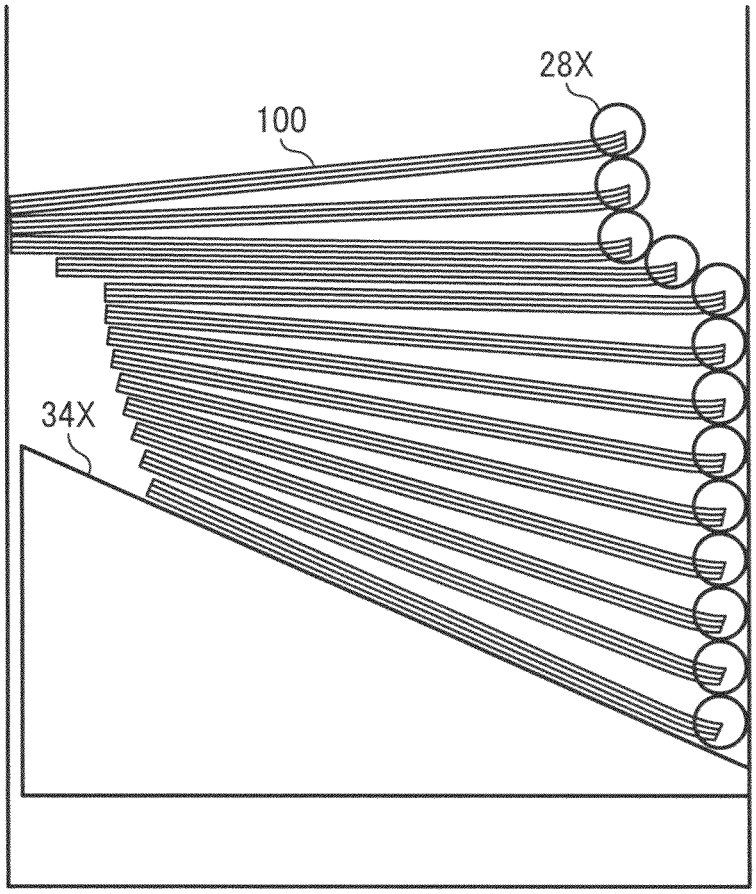
FIG. 11 RELATED ART
FIG. 11 illustrates multiple booklets stacked in a related-art booklet stacker.

A control block of the bookbinding system is described below with reference to FIG. 10.

The MFP 1, the ring-binding device 7, and the finisher 8 respectively include a control circuit including a central processing unit (CPU) 1U, 7U, and 8U serving as controllers, and each of the CPUs 1U, 7U, and 8U reads out program codes from a read-only memory (ROM), runs the program codes in a random-access memory (RAM), and then performs operations defined by the program codes using the RAM as a work area and a data buffer. Each of the CPUs 1U, 7U, and 8U, the ROM, and the RAM are resources of the computer, and the computer controls that device and communicates with other devices using those resources. In the present embodiment, the MFP 1, the inserter 4, the ring-binding device 7, and the finisher 8 together form the bookbinding system.

The MFP 1 and the finisher 8 further include communication ports 1P and 8P, respectively. The ring-binding device 7 further includes communication ports 7P1 and 7P2. The MFP 1 and the ring-binding device 7 can communicate with each other using the communication ports 1P and 7P1, and the ring-binding device 7 and the finisher 8 can communicate with each other using the communication ports 7P2 and 8P.

The MFP 1, the ring-binding device 7, and the finisher 8 are connected in series electrically via the communication ports 1P, 7P1, 7P2, and 5P.

A configuration and operations of the ring-binding device 7 are described below.

Figure 2:
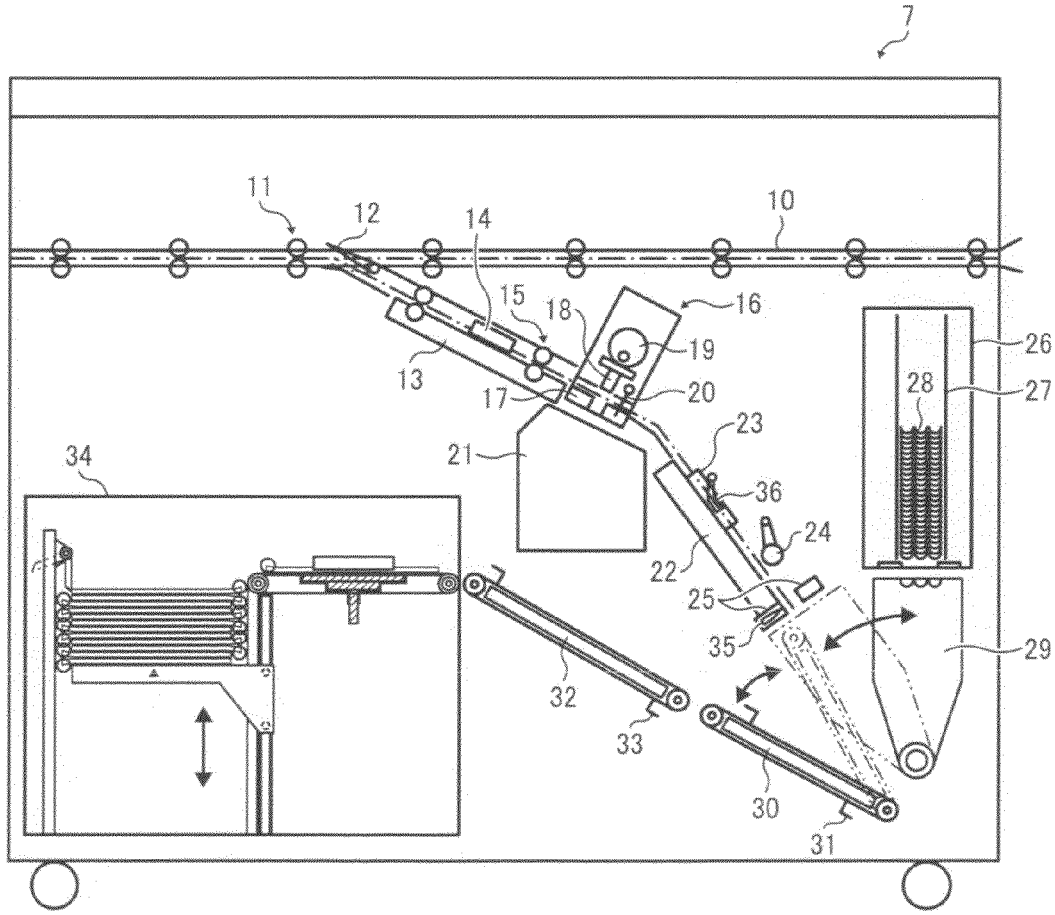
FIG. 2 illustrates a configuration of a post-processing apparatus.

FIG. 2 illustrates a configuration of the ring-binding device 7.

The ring-binding device 7 performs ring binding online. The ring-binding device 7 includes a horizontal transport path 10, aligning trays 13 and 22, a hinged transport unit 30, a downstream transport unit 32, and a booklet stacker 34 disposed in that order along a sheet conveyance path in the ring-binding device 7. The ring-binding device 7 further includes a clamp 25 to hold the ring member and a ring-binding unit 29.

The sheet output from the MFP 1 is transported along the horizontal transport path 10 in the ring-binding device 7. The sheet is horizontally transported to the finisher 8 when ring binding is not performed. When ring binding is to be performed, the sheet is reversed by a pair of reverse rollers 11 disposed in a downstream portion of the horizontal transport path 10 in the sheet conveyance direction. Then, a switch pawl 12 disposed along the horizontal transport path 10 changes a route of the sheet, and the sheet is transported obliquely downward to a punch part including the aligning tray 13, a punch unit 16, a jogger 14 disposed above the aligning tray 13, a pair of transport rollers 15, and a stopper 20 disposed downstream from the aligning tray 13. The punch unit 16 includes a die 17, a punch 18, and a cam 19. It is to be noted that multiple pairs of rollers are provided along the horizontal transport path 10 and other sheet conveyance paths to transport the sheet therethrough.

In the punch part, when the sheet is placed on the aligning tray 13, the jogger 14 aligns the sheet in a transverse direction or width direction, perpendicular to the sheet conveyance direction. The transport rollers 15 transport the sheet so that a leading edge portion (front end portion) of the sheet contacts the stopper 20 disposed downstream from the aligning tray 13, projecting into the sheet conveyance path, and thus a position of the sheet is fixed in the sheet conveyance direction. In other words, the position of the sheet is fixed on the aligning tray 13 in both the transverse direction and the sheet conveyance direction by the jogger 14 and the stopper 20, respectively. The jogger 14 includes a right jogger and a left jogger driven by different driving sources, and the right jogger and the left jogger can be positioned separately regardless of the center of the sheet in the width direction. With this configuration, the center of the line of ring holes formed in the sheet can be deviated from the center of the sheet. It is to be noted that the sheet is not damaged by the contact with the stopper 20 because the transport rollers 15 are provided with a torque limiter.

Subsequently, the sheet is punched by the punch unit 16. When the sheet is positioned by the jogger 14 and the stopper 20, a part of the sheet is on the die 17. In this state, the cam 19 rotates to push the punch 18 down, and thus multiple punch holes (ring holes) arranged in a row at predetermined or given constant intervals are formed in the sheet placed between the die 17 and the punch 18. Each ring hole is punched at a predetermined or given distance from the stopper 20. The punch unit 16 punches multiple ring holes for ring binding. After the sheet is thus punched, the stopper 20 is disengaged from the sheet, thus forwarding the sheet downstream in the sheet conveyance direction to an aligning section. Chads generated by punching are held in a punch chad container 21 disposed beneath the punch unit 16.

The aligning section receives a bundle of sheets to be bound together one by one and stacks the sheets on the aligning tray 22 as well as aligns them. The aligning tray 22 is provided with a transverse jogger 23 and a roller 24 that pushes the sheet in the sheet conveyance direction. While the roller 24 pushes the sheets against a fence (not shown), aligning the sheet in the sheet conveyance direction, the transverse jogger 23 aligns the sheets in the transverse direction. An auxiliary fence 36 is provided inside the transverse jogger 23 so that the transverse jogger 23 can align sheets of different sizes that are to be bound together. With the auxiliary fence 36, even when the front cover and the back cover is larger then the sheets sandwiched therebetween, the transverse jogger 23 can align them.

The aligning section further includes an aligning pin 35 that engages the ring holes formed in the multiple sheets to improve alignment of sheets relative to the ring holes after all of the sheets to be bound together are stacked on the aligning tray 22. An edge portion of the aligning pin 35 is tapered, and the multiple sheets can be aligned as the edge portion of the aligning pin 35 is inserted into the punch hole. By aligning the sheets relative to the ring holes, the sheets can be aligned reliably even when sizes of the sheets are different.

Subsequently, ring binding is performed. After a bundle of sheets are aligned on the aligning tray 22, the clamp 25 presses and holds an edge portion of the sheets on the side to be bound (hereinafter "bound side"). A ring cartridge holder 26 disposed close to the aligning tray 22 holds a ring cartridge 27 containing multiple ring members 28. In the present embodiment, the ring member 28 is a plastic member and includes a bar to which multiple rings are attached, and each ring is divided into three portions that are connected so as to be openably closable. While the clamp 25 thus holds a bundle of sheets, the ring-binding unit 29 swings to a position under the ring cartridge 27 to receive one of the ring members 28, swings back to under the clamp 25 with the ring member 28, and then puts the rings of tfie ring member 28 into the respective ring holes formed on the sheets.

After the multiple sheets are thus bound with the ring member 28 as a booklet 100 (shown in FIG. 3), the transport unit 30 swings to a position under the clamp 25. Then, the clamp 25 is released, and thus the ring-bound booklet 100 is placed on the transport unit 30, received by a release pawl 31 provided on a belt of the transport unit 31. Subsequently, the transport unit 30 swings counterclockwise in FIG. 2 to align with the downstream transport unit 32. Then, the release pawl 31 forwards the ring-bound booklet 100 to the downstream transport unit 32 that is provided with a release pawl 33. Then, the release pawl 33 discharges the ring-bound booklet 100 onto the booklet stacker 34. The booklet 100 is thus bound with the ring member 28 and then placed on the booklet stacker 34.

Figure 3:
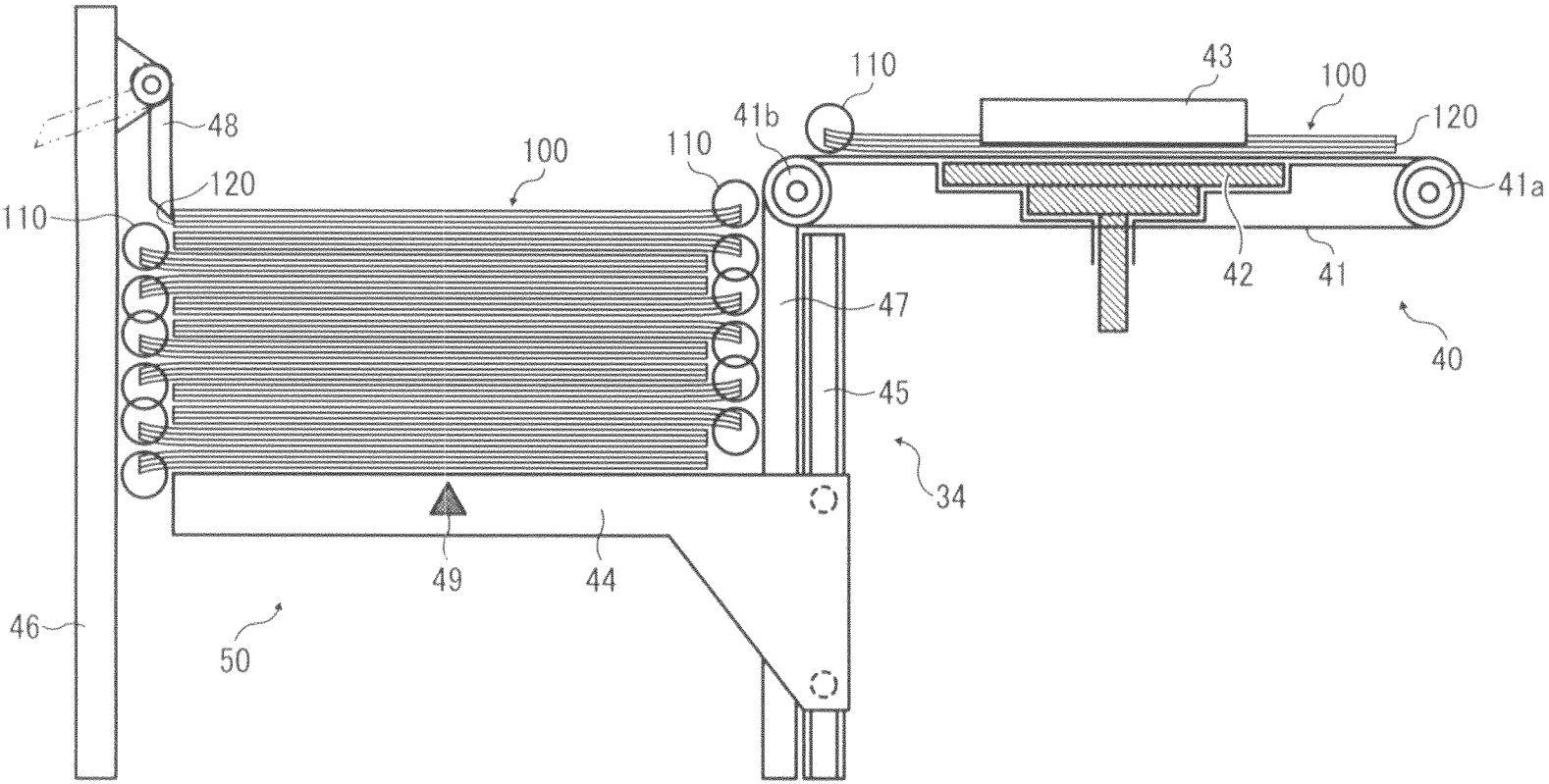
FIG. 3 illustrates a configuration of a booklet stacker included in the post-processing apparatus shown in FIG. 2.

FIG. 3 is a schematic view illustrating a configuration of the booklet stacker 34 according to the present embodiment.

The booklet stacker 34 includes an rotary alignment portion 40 and a loading portion 50 positioned on the upstream side and the downstream side, respectively, in a direction in which the booklet 100 is transported (hereinafter "booklet conveyance direction").

The rotary alignment portion 40 is positioned downstream from the downstream transport unit 32 and includes a conveyance belt 41 to transport the booklet 100, a rotary table 42 to rotate the booklet 100 placed thereon, and a pair of joggers 43, disposed on both sides of a booklet conveyance path through which the booklet 100 is conveyed to the loading portion 50, to adjust the position of the booklet 100 placed on the rotary table 42 in the width direction perpendicular to the booklet conveyance direction.

It is to be noted that the pair of joggers 43 serves as a shifter, the conveyance belt 41 serves as a booklet conveyer, and the rotary table 42 serves as a rotator.

The conveyance belt 41 is stretched around a driving pulley 41*a* and a driven pulley 41*b*, extends horizontally, and rotates counterclockwise in FIG. 3. The conveyance belt 41 has a horizontally extending portion longer than the length of the booklet 100 in the booklet conveyance direction.

The rotary table 42 is positioned in a center portion of the conveyance belt 41, rotates horizontally, and moves vertically in FIG. 3. Motor driving is used to rotate and move the rotary table 42 vertically, which is described below with reference to FIGS. 5 and 6. In the present embodiment, the conveyance belt 41 is constituted of a pair of relatively narrow parallel belts, disposed on both sides of the sheet conveyance path, and the rotary table 42 is positioned between the pair of parallel belts 41 to prevent the interference between the conveyance belt 41 and the rotary table 42.

The pair of joggers 43 moves reciprocally in the direction perpendicular to the booklet conveyance direction to push the booklet 100 from both sides, thus positioning the booklet 100 relative to the center of the sheet conveyance path. The pair of joggers 43 is moved by a known motor driving mechanism and the description thereof is omitted.

The loading portion 50 includes a stack tray 44 on which the booklet 100 is stacked, a guide rail 45 that supports the stack tray 44 and guides the vertical movement thereof, a front fence 46 to regulate the position of the front end (downstream side) of the booklet 100 in the booklet conveyance direction, a back fence 47 to regulate the position of the back end (upstream side) of the booklet 100 in the booklet conveyance direction), a leading-edge stopper 48 to regulate the position of the front end of the booklet 100, and a sheet detector 49 to detect the booklet 100 on the stack tray 44. The stack tray 44 can move vertically in FIG. 3 along the vertically extending guide rail 45, driven by a driving mechanism, not shown. The vertical position of the stack tray 44 to receive the booklet 100 transported from the rotary alignment portion 40 is adjusted according to a detection result generated by a sheet surface detector, not shown, that detects an upper surface of the booklet 100 on the top on the stack tray 44.

More specifically, the ring-bound booklet 100 is conveyed from the downstream transport unit 32 to the rotary alignment portion 40 of the booklet stacker 34. Then, the booklet 100 is conveyed by the conveyance belt 41 toward the loading portion 50 and stopped in a center portion of the rotary alignment portion 40. When the booklet 100 is to be rotated, the rotary table 42 ascends, lifts the booklet 100 above the conveyance belt 41, and then rotates 180 degrees, thereby causing the booklet 100 to turn 180 degrees. Further, the pair of joggers 43 aligns the booklet 100 in the direction perpendicular to the surface of paper on which FIG. 3 is drawn.

After the booklet 100 is rotated and aligned as described above, the rotary table 42 descends, leaving the booklet 100 on the conveyance belt 41, and then the conveyance belt 41 conveys the booklet 100 to the stack tray 44. The stack tray 44 is supported by the guide rail 45 and is reciprocally movable vertically as described above. Additionally, the front fence 46 is provided on the downstream side (front side) of the stack tray 44 in the booklet conveyance direction. When booklet 100 is placed on the stack tray 44 with its bound side forming the front side, the booklet 100 is pushed so that the rings 110 of the booklet 100 contact the front fence 46, thereby aligning the booklet 100. The position of the front fence 46 in the booklet conveyance direction can be adjusted according to the size of the booklet 100. A driving mechanism, not shown, moves the front fence 46 along a guide, not shown, disposed in parallel to the booklet conveyance direction. It is to be noted that, in FIG. 3, reference number 110 represents the closed rings of the ring member 28, shown in FIG. 2, penetrating the ring holes in the booklet 100. The terms "bundle of sheets" and "booklet" respectively mean the sheets before and after the ring binding.

The back fence 47 provided on the trailing side, that is, the upstream side in the booklet conveyance direction, aligns the booklet 100 placed on the stack tray 44 with the bound side forming the trailing side. More specifically, the rings 110 of the booklet 100 contact the back fence 47, thereby aligning the booklet 100 on the upstream side. At that time, the booklet 100 with the bound side forming the trailing side is positioned in the booklet conveyance direction by the leading-edge stopper 48. The leading-edge stopper 48 can pivot between a regulation position indicated by solid lines and a release position indicated by broken lines shown in FIG. 3. The leading-edge stopper 48 is at the release position indicated by broken lines, away from the booklet 100, when the bound side of the booklet 100 is on the front side. When an unbound side 120 of the booklet 100 opposite the bound side is on the front side, the leading-edge stopper 48 pivots to the regulation position, indicated by solid line, thus stopping the booklet 100 at a position upstream from the rings 110 of the lower booklet 100 so that the unbound side 120 of booklet 100 on the top does not interfere with the rings 110 of the lower booklet 100. Thus, the booklet 100 positioned with the unbound side 120 forming the front side is shifted from the lower booklet 100 upstream in the booklet conveyance direction by a predetermined or given distance to avoid the interference with the rings 110. The CPU of the ring-biding device 7 determines the predetermined distance according to the diameter of the rings 110.

The configuration and the operation of the leading-edge stopper 48 are described in further detail later with reference to FIGS. 7 and 8.

In the present embodiment, to prevent the pile of booklets 100 from tilting, the direction of the booklet 100 on the tray 44, that is, the side of the booklet 100 forming the leading side or front side, is changed between the bound side and the unbound side 120 each time a predetermined number of booklets 100 are piled. In addition, regarding the predetermined number of ring-bound booklets 100 piled one on another in the same direction, the upper booklet 100 is at a predetermined position shifted from the lower booklet 100 (hereinafter "predetermined shifted position") in the width direction perpendicular to the booklet conveyance direction so that the rings 110 of the upper booklet 100 do not contact the rings 110 of the lower booklet 100. In the present embodiment, to prevent the pile of multiple ring-bound booklets 100 from tilting, the initial booklet 100 is stacked on the stack tray 44 with the side of the rings 110 forming its front end portion as shown in FIG. 3.

It is to be noted that the pair of joggers 43 can shift each bundle of sheets in the width direction perpendicular to the booklet conveyance direction regardless of whether sheets are bound with a ring member or unbound, and thus multiple bundles of unbound sheets can be separated from each other as well. In a related matter, the CPU (controller) of the ring-biding device 7 can be configured to drive the punch unit 16 independently of the ring-binding unit 29 so that a bundle of punched sheets can be conveyed to the booklet stacker 34 without ring binding.

FIGS. 4A through 4D illustrate operations of the booklet stacker 34.

Figure 4A:
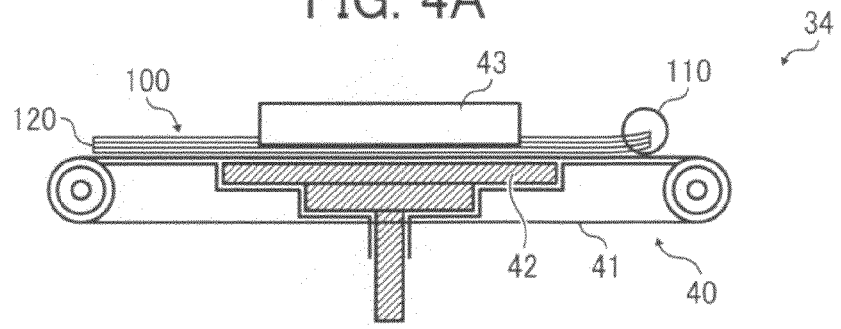
FIGS. 4A through 4D illustrate operations of the booklet stacker shown in FIG. 3.

In the present embodiment, as shown in FIG. 4A, when the booklet 100 is conveyed from the downstream transport unit 32 to the rotary alignment portion 40, the pair of joggers 43 aligns the booklet 100 in the width direction, perpendicular to the booklet conveyance direction as well as the surface of paper on which FIGS. 4A through 4D are drawn. In the alignment in the direction perpendicular to the booklet conveyance direction, the booklet 100 currently aligned is at the predetermined shifted position deviated a distance shorter than the pitch of the rings 110 (hereinafter "ring pitch") from each other in the direction perpendicular to the booklet conveyance direction. For example, the shift distance is greater than a width, that is, a length in the direction perpendicular to the booklet conveyance direction, of the ring 110 so that the rings 110 of the lower booklet and the upper booklet does not interfere with each other. In the present embodiment, the distance by which the rings 100 of the two adjacent booklets 100, stacked in the same direction, is half the ring pitch, for example.

Figure 4B:
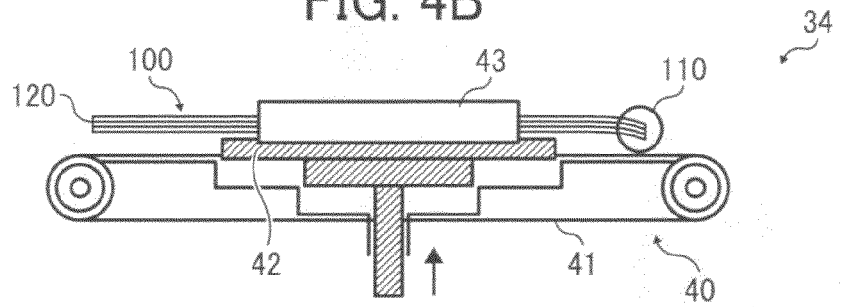
Figure 4C:
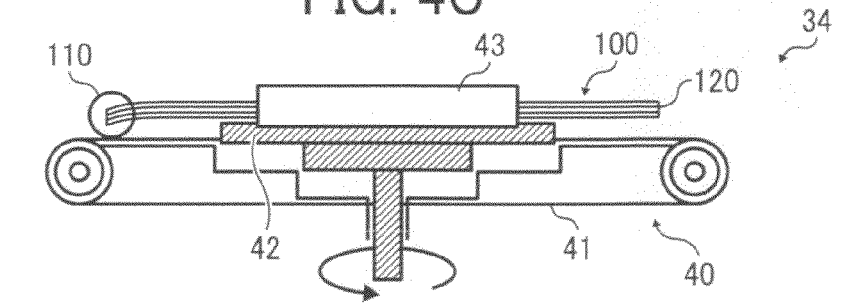
Figure 4D:
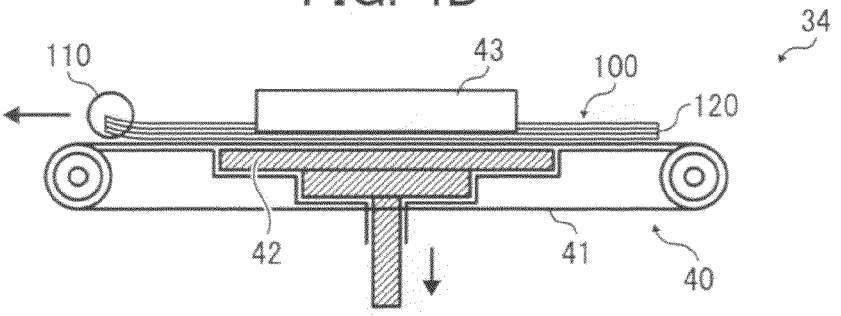

After the pair of joggers 43 thus aligns the booklet 100, as shown in FIG. 4B, the rotary table 42 ascends to disengage the booklet 100 from the conveyance belt 41 because the booklet 100 is conveyed to the rotary alignment portion 40 with the side of the rings 110 forming the trailing side. Subsequently, as shown in FIG. 4C, the rotary table 42 rotates 180 degrees, thereby turning the booklet 100 to turn 180 degrees. Further, the pair of joggers 43 sets the booklet 43 to the predetermined shifted position, after which the rotary table 42 descends, leaving the booklet 100 on the conveyance belt 41 as shown in FIG. 4D so that the booklet 100 is conveyed by the conveyance belt 41 to the stack tray 44.

The conveyance belt 41 is driven in this state, and the booklet 100 is stacked on the previous booklet 100 on the stack tray 44. When the booklet 100 is released from the conveyance belt 41, the leading-edge stopper 48 is at the release position indicated by broken lines shown in FIG. 3, away from the booklet 100 as described above. The front fence 46 regulates the position of the rings 110 of the booklet 100, which is positioned on the front side while the rotary table 42 rotates, thus aligning the booklet 100 in the booklet conveyance direction on the stack tray 44.

In the present embodiment, each time a predetermined number, which is two in the configuration shown in FIG. 3, of booklets 100 are stacked on the stack tray 44 in the same direction, the direction of the booklets 100 is changed 180 degrees. Therefore, the second booklet 100 is rotated similarly to the initial booklet 100 and then aligned by the pair of joggers 43. In the alignment in the direction perpendicular to the booklet conveyance direction, the position of the second booklet 100 is deviated haft the ring pitch from the initial booklet 100 as described above. Subsequently, when the second booklet 100 is released from the conveyance belt 41 and stacked on the stack tray 44, the rings 110 of the second booklet 100 are deviated haft the ring pitch from the rings 110 of the initial booklet 100. Thus, the rings 110 of the booklets 100 piled on the stack tray 44 do not interfere with each other.

The third booklet 100 and the fourth booklet 100 are not rotated and are aligned by the pair of joggers 43. At that time, similarly to the previous two booklets 100, the third booklet 100 and the fourth booklet 100 are positioned so that their rings 110 are deviated half the ring pitch from each other in the direction perpendicular to the booklet conveyance direction. Thus, the rings 110 of the stacked booklets 100 do not interfere with each other also on the trailing side. In this state, the position of the rings 110 of the third and fourth booklets 100 in the booklet conveyance direction is different form that of the previous two booklets 100. Further, because the leading-edge stopper 48 positions the unbound side 120 of the third and fourth booklets 100 not to overlap with the rings 110 of the previous two booklets 100, the rings 110 of the previous two booklets 100 do not interfere with the unbound side 120 of the third and fourth booklets 100.

As described above, each time the predetermined number of booklets 100 are stacked on the stack tray 44, the direction of the booklets 100 is changed 180 degrees. Further, the pair of joggers 43 sets the predetermined number of booklets 100 to be stacked in the same direction at positions deviated from each other half the ring pitch in the direction perpendicular to the booklet conveyance direction. With this configuration, the rings 110 of the predetermined number of booklets 100 stacked in the same direction can be prevented from interfering with each other because the rings 110 are sifted from each other. Additionally, interference of the rings 110 can be prevented between the booklets 100 stacked on the different directions.

Figure 5:
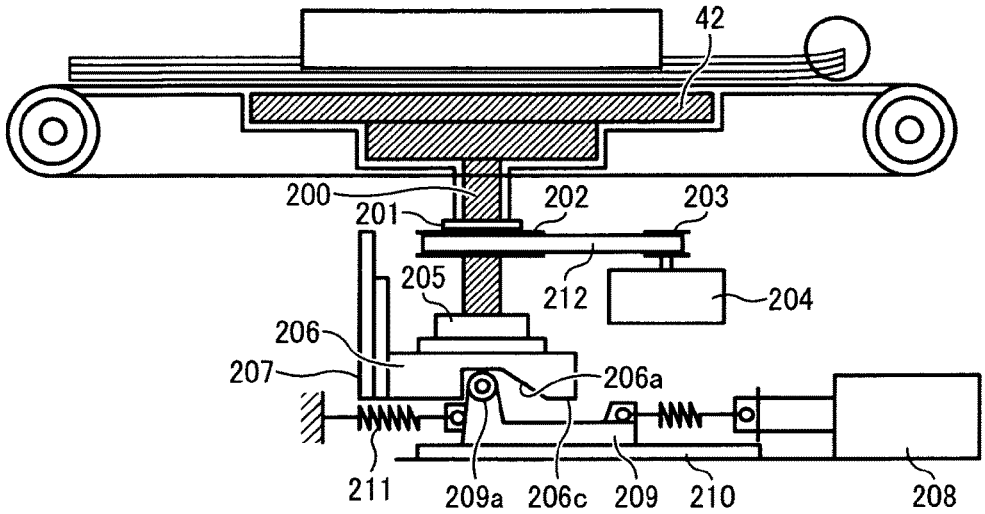
FIG. 5 illustrates a mechanisms to rotate and vertically move a rotary table, shown in FIGS. 4A through 4D, in which the rotary table is at a lower position.
Figure 6:
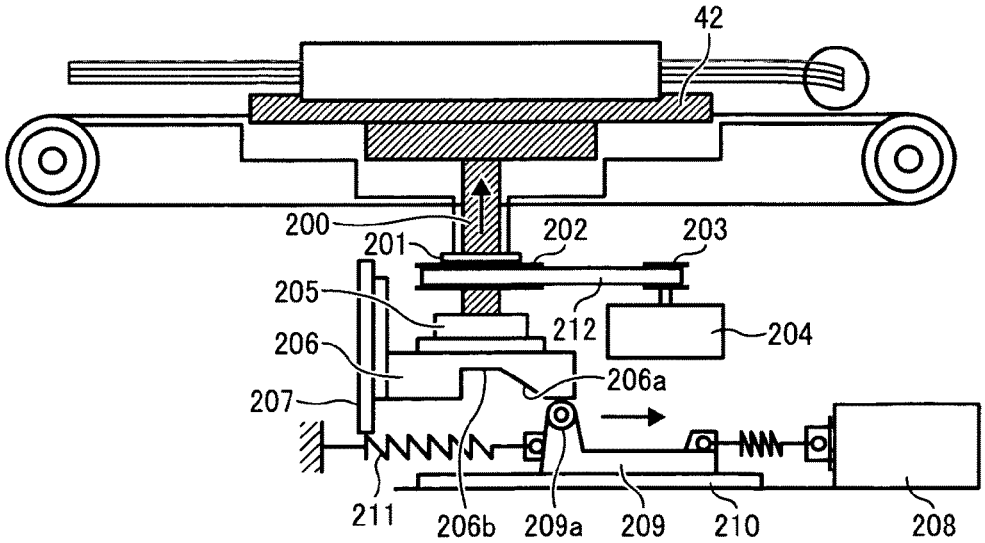
FIG. 6 illustrates the mechanisms to rotate and vertically move the rotary table, shown in FIGS. 4A through 4D, in which the rotary table is at an upper position.

FIGS. 5 and 6 illustrate the mechanism to rotate the rotary table 42 shown in FIGS. 4A through 4D and an elevation mechanism to move the rotary table 42 vertically.

Referring to FIGS. 5 and 6, the rotary table 42 is fixed to a shaft 200, extending vertically in FIGS. 5 and 6, positioned at a center of rotation of the rotary table 42. A driving pulley 202 for rotating the rotary table 42 is loosely fitted around the shaft 200, and the shaft 200 can move slidingly in its axial direction relatively to the driving pulley 202. Further, to transmit the driving force to rotate the rotary table 42 with the driving pulley 202, the shaft 200 is D-shaped in a cross section at least in a sliding portion with the driving pulley 202. It is to be noted that, alternatively, the shaft 200 may be square or splined in the sliding portion with the driving pulley 202.

The driving pulley 202 is supported by the shaft 200 in the thrust direction and does not move vertically as the shaft 200 moves vertically. A belt 212 is wound around the driving pulley 202 and another pulley 203 connected to a motor 204, and rotation of the motor 204 is transmitted via the pulley 203 and the belt 212 to the driving pulley 202, which rotates the shaft 202. With this configuration, the rotary table 42 is rotated.

Additionally, a lower end portion of the shaft 200 is supported by a thrust bearing 205. A guide 206 disposed beneath the thrust bearing 205 is attached to a slide rail 207 extending vertically in FIGS. 5 and 6, and thus the guide 206 can move vertically. A sliding member 209 including a driving roller 209*a* disposed beneath the guide 206 engages a cam surface provided on a lower side of the guide 206. The sliding member 209 is slidingly attached to a slide rail 210 extending horizontally in FIGS. 5 and 6 and thus can move horizontally. The cam surface of the guide 206 includes a sloped portion 206*a* to convert horizontal movement of the sliding member 209 into vertical movement of the guide 206. When the driving roller 209*a* is positioned in an upper horizontal portion 206*b* (shown in FIG. 6) above the sloped portion 206*a*, the rotary table 42 is at a lowest position as shown in FIG. 5, and when the driving roller 209*a* is positioned in a lower horizontal portion 206*c* beneath the sloped portion 206*a*, the rotary table 42 is at a highest position as shown in FIG. 6.

The sliding member 209 is driven by pulling and release of the solenoid 208. When the solenoid 208 is on, the solenoid 208 pulls the sliding member 209 from the position shown in FIG. 5 to the position shown in FIG. 6, and accordingly the driving roller 209*a* lifts the guide 206 as well as the shaft 200 along the sloped portion 206*a*. When the solenoid 208 is turned off, the sliding member 209 reverts to the position shown in FIG. 5 due to the elastic force of a spring 211 attached to the sliding member 209 and a housing or the like, and thus the guide 206 as well as the shaft 200 descend. With this configuration, the rotary table 42 can rotate and move vertically.

Figure 7:
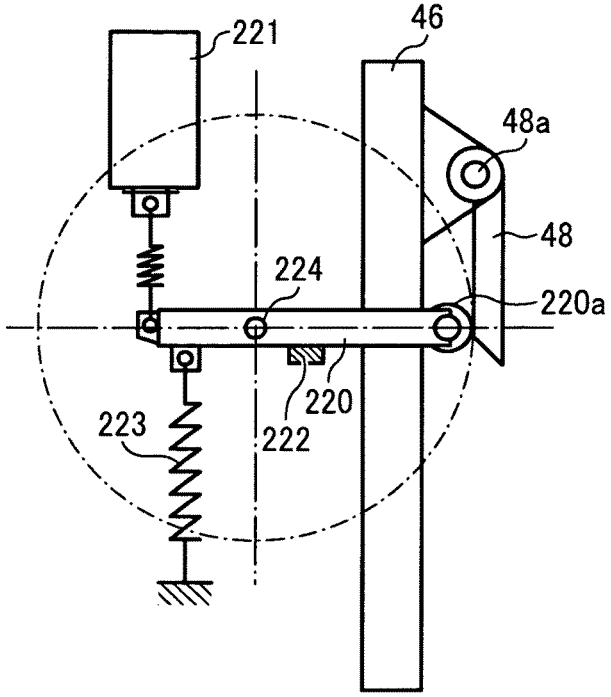
FIG. 7 illustrates a configuration and operation of a front stopper shown in FIG. 3, in which the front stopper is at a regulation position.
Figure 8:
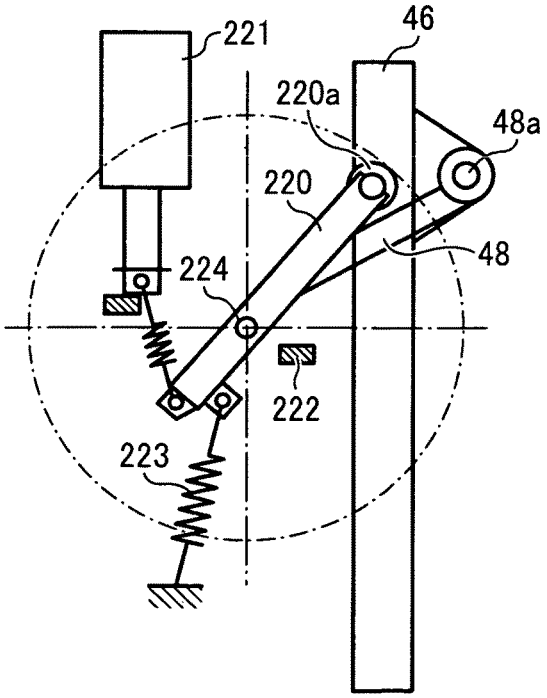
FIG. 8 illustrates the configuration and operation of the front stopper shown in FIG. 3, in which the front stopper is at a release position.

FIGS. 7 and 8 illustrate a configuration and operation of the leading-edge stopper 48.

Referring to FIGS. 7 and 8, the leading-edge stopper 48 is pivotally attached via a support shaft 48*a* to a surface of the front fence 46 facing the booklet 100 stacked on the stack tray 44 (shown in FIG. 3). A bias member, not shown, biases the leading-edge stopper 48 constantly to the release position away from the booklet 100 on the stack tray 44. A solenoid 221 and a lever 220 driven by the solenoid 221 are disposed on the side of the front fence 46 opposite the side of the leading-edge stopper 48 and slidingly attached to a shaft 224. A roller 220*a* is rotatably attached to a first end portion of the lever 220 facing the booklet 100 on the stack tray 44, contacts a surface of the leading-edge stopper 48 facing the front fence 46, and can rotate on that surface of the leading-edge stopper 48. In FIGS. 7 and 8, a lever stopper 222 provided beneath the lever 220 in FIG. 7 limits the clockwise rotation of the lever 220, and a spring 223, attached to a second end portion of the lever 220 opposite the roller 220*a*, and a stroke of the solenoid 221 limits the counterclockwise rotation of the lever 220.

With the above-described configuration, the leading-edge stopper 48 is pushed by the clockwise rotation of the lever 220 from the state shown in FIG. 8, pivots around the support shaft 48*a*, and moves to the regulation position shown in FIG. 7. More specifically, when the solenoid 221 is turned on, the lever 220 is pulled and rotated from the state shown in FIG. 8 to a position in contact with the lever stopper 222. This position is the regulation position of the leading-edge stopper 48. When the solenoid 221 is turned off in this state, the elastic force of the spring 223 causes the lever 220 to rotate as shown in FIG. 8, and accordingly the leading-edge stopper 48 moves away from the stay 44 (shown in FIG. 3) to the release position.

Figure 9:
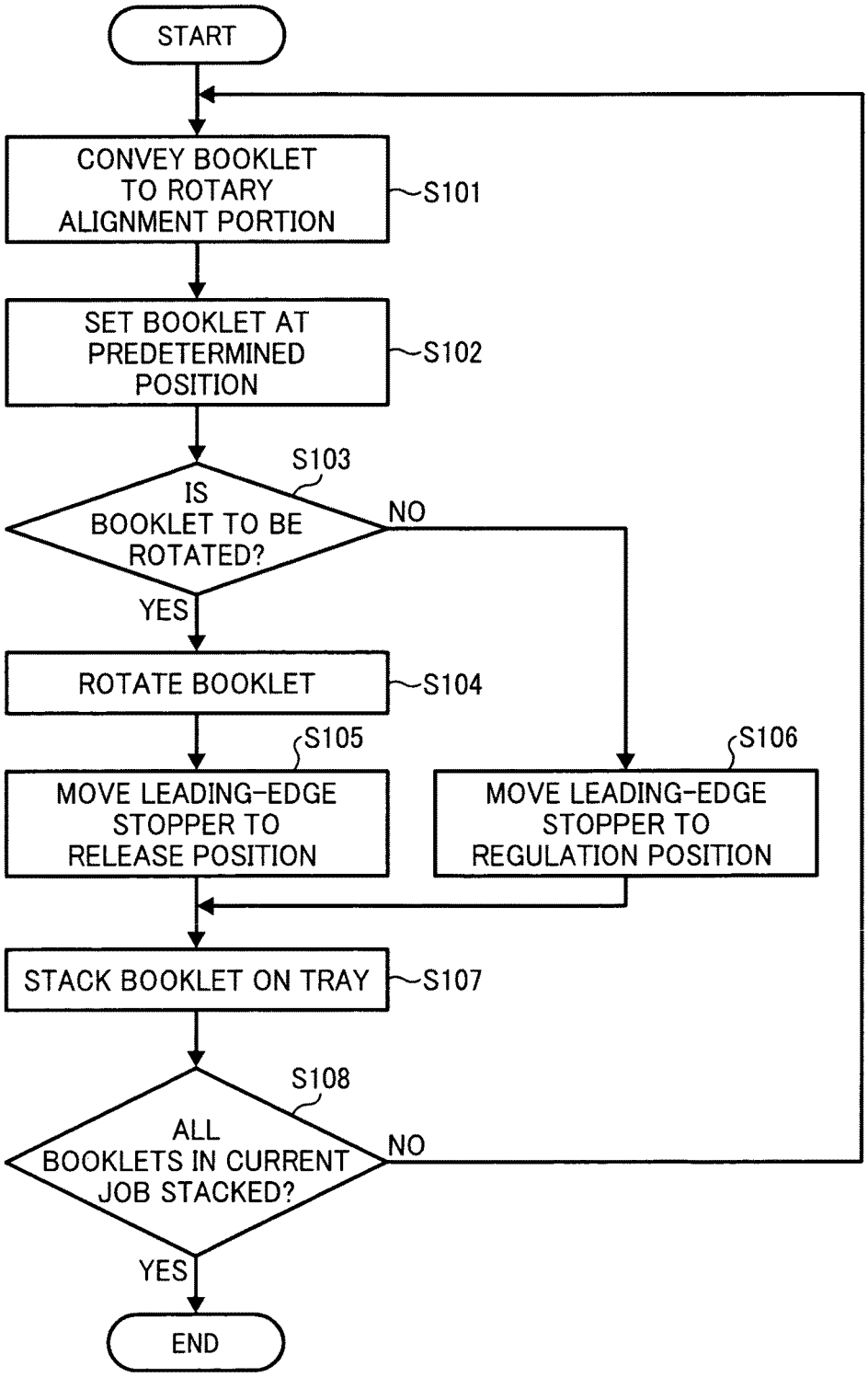
FIG. 9 is a flowchart of processes of stacking multiple booklets using the booklet stacker shown in FIGS. 3 through 4D

FIG. 9 is a flowchart of processes of stacking multiple booklets 100 using the booklet stacker 34.

The CPU, not shown, of the ring-binding device 7 performs the stacking processes according to instructions from the CPU, not shown, of the MFP 1.

Referring to FIG. 9, at S101, the booklet 100 is conveyed from the downstream transport unit 32 to the booklet stacker 34 and stopped in the rotary alignment portion 40 as shown in FIG. 4A. At S102, the pair of joggers 43 sets the booklet 100 at the predetermined shifted position. At S103, according to the data transmitted from the CPU of the MFP 1, the control unit of the ring-binding device 7 checks whether or not the booklet 100 should be rotated. When the booklet 100 is to be rotated (YES at S103), at S104 the booklet 100 is rotated as described above with reference to FIGS. 4B through 4D. At S105, the leading-edge stopper 48 moves to the release position, indicated by broken lines in FIG. 3, away from the booklet 100, after which, at S107, the booklet 100 is stacked on the stack tray 44 of the loading portion 50.

By contrast, when the booklet 100 is not to be rotated (NO at S103), at S106 the leading-edge stopper 48 moves to the regulation position indicated by solid lines shown in FIG. 3 and positions the booklet 100. Then, at S107, the booklet 100 is stacked on the stack tray 44. At S108, the control circuit checks whether or not the previous booklet 100 is the last one in the current job. When the previous booklet 100 is the last one (NO at S108), the steps from S101 through S107 are repeated for each remaining booklet in the current job until the last one in the current job is stacked onto the stack tray 44 (YES at S108).

It is to be noted that, the term "job" herein means a single task ordered by the MFP 1, such as, forming 30 booklets each containing 50 sheets. In this case, the last booklet in the job means the thirtieth booklet.

As described above, the present embodiment can attain the following effects.

1) The rings 110 binding the respective booklets 100 stacked on the stack tray 44 can be prevented from interfering with each other because the rings 110 are sifted half the ring pitch from each other in the width direction perpendicular to the booklet conveyance direction. As a result, the pile of booklets can be kept flat.

2) Because the piled booklets 100 can be kept flat, the number of booklets 100 stacked on the stack tray 44 can be increased.

3) Because the rings 110 of the predetermined number of booklets 100 stacked in the same direction are sifted half the ring pitch from each other in the width direction, the rings 110 can be prevented or inhibited from overlapping and interfering with each other.

4) The pressure of the ring 110 of one of two adjacent booklets 100 stacked on the same direction to the other booklet 100 can be reduced, thus preventing or reducing damage to the booklet 100.

5) Because kept flat on the stack tray 44, the booklets 100 need not to be aligned again after removed from the stack tray 44.

6) Regardless of whether sheets are bound with a ring member or unbound, the booklet stacker 34 can shift each bundle of sheets in the width direction perpendicular to the booklet conveyance direction, and thus multiple bundles of unbound sheets can be separated from each other as well.

7) Thus, the booklet stacker according to the present embodiment can have sophisticated functions and exhibit enhanced reliability in stacking multiple booklets.

Thus, according to the present embodiment, the pile of ring-bound booklets can be kept flat on the stack tray, damage to the booklets is prevented or reduced, and alignment of the booklets after removed from the stack tray can be secured.

Numerous additional modifications and variations are possible in light of the above teachings. It is therefore to be understood that, within the scope of the appended claims, the disclosure of this patent specification may be practiced otherwise than as specifically described herein.

What is claimed is:

1. A booklet stacker to stack multiple booklets each bound with a ring member, discharged from a sheet processing device, the booklet stacker comprising:

a vertically adjustable stack tray configured to receive multiple booklets, each bound with a ring member, in a stack;

a shifter disposed upstream from the stack tray in a booklet conveyance direction in which a booklet is conveyed;

a controller configured to cause the shifter to adjust a position of a booklet with a ring member in a width direction perpendicular to the booklet conveyance direction by shifting the booklet in the width direction a distance shorter than a ring pitch of the ring member;

a booklet conveyer disposed upstream from the stack tray in the booklet conveyance direction, to convey the booklet positioned by the shifter to the stack tray; and a rotator, rotatable 180 degrees, the rotator being configured to rotate 180 degrees the booklet, wherein the booklet conveyer is configured to convey the booklet rotated 180 degrees by the rotator to the stack tray, and wherein the rotator is a rotary table within the booklet conveyor and beneath the shifter.

2. The booklet stacker according to claim 1, further comprising an elevation mechanism to move the rotator vertically to lift the booklet off the booklet conveyer.

3. The booklet stacker according to claim 2, wherein the booklet conveyer comprises a pair of parallel belts extending in the booklet conveyance direction on lateral sides of the rotator, disposed on both sides of a booklet conveyance path through which the booklet is conveyed to the stack tray, and the rotator is positioned between the pair of parallel belts.

4. The booklet stacker according to claim 1, further comprising:

a front fence disposed on a downstream end portion of the stack tray to regulate a position of a front end portion of the ring member of the booklet stacked on the stack tray, with a bound side of the booklet forming the front end portion of the booklet in the booklet conveyance direction.

5. The booklet stacker according to claim 4, wherein the booklet conveyer conveys multiple booklets in succession with the bound sides of the multiple booklets forming the front end portions of the booklets.

6. The booklet stacker according to claim 1, further comprising:

a back fence disposed on an upstream end portion of the stack tray to regulate a position of a back end portion of the ring member of the booklet stacked on the stack tray, with an unbound side of the booklet opposite the bound side forming the front end portion of the booklet in the booklet conveyance direction.

7. The booklet stacker according to claim 6, wherein the booklet conveyer conveys multiple booklets in succession with the unbound sides of the multiple booklets forming the front end portions of the booklets.

8. The booklet stacker according to claim 1, further comprising a front end regulation member for adjusting a position of a front end portion of a top booklet stacked on a top of the multiple booklets on the stack tray, wherein, when the top booklet is stacked with an unbound side forming a front end portion thereof on a previous booklet stacked on the stack tray with a bound side forming a front end portion thereof, the front end regulation member positions the front end portion of the top booklet upstream from the ring member of the previous booklet in the booklet conveyance direction.

9. The booklet stacker according to claim 8, wherein the front end regulation member comprises a pivotable member disposed on a downstream side of the stack tray, and pivotable between a release position away from the booklet stacked on the stack tray and a regulation position upstream from the front end portion of the previous booklet stacked on the stack tray in the booklet conveyance direction when the top booklet is stacked with the unbound side forming the front end portion of the top booklet on the previous booklet stacked on the stack tray with the bound side forming the front end portion of the previous booklet in the booklet conveyance direction.

10. The booklet stacker according to claim 1, wherein the rotator rotates about a vertical shaft.

* * * * *